United States Patent [19]

Marbury

[11] 4,006,905

[45] Feb. 8, 1977

[54] SOLITAIRE GAME LAP BOARD

[76] Inventor: Thomas Kingston Marbury, 227 Harrill St., Forest City, N.C. 28043

[22] Filed: Apr. 21, 1975

[21] Appl. No.: 569,808

[52] U.S. Cl. ..... 273/148 A; 273/150

[51] Int. Cl.[2] ..... A63F 1/10

[58] Field of Search ..... 273/148 A, 150

[56] References Cited

UNITED STATES PATENTS

| | | | |
|---|---|---|---|
| 2,081,520 | 5/1937 | Warner | 273/148 A |
| 2,364,814 | 12/1944 | Plummer et al. | 273/136 C |
| 3,224,780 | 12/1965 | Mohl | 273/148 A |
| 3,801,106 | 4/1974 | Milton | 273/161 |
| 3,891,220 | 6/1975 | Driver | 273/148 A |
| D79,453 | 9/1929 | Behr | 273/148 A UX |
| D158,962 | 6/1950 | Jacob | 273/148 A X |

*Primary Examiner*—Anton O. Oechsle

[57] ABSTRACT

A solitaire game board adapted to rest on the lap of the user. The board comprises a rigid body the upper surface of which is stepped from the front to the back thereof. Longitudinally extending dividers disposed on the stepped surface divide the surface into seven forwardly and rearwardly extending areas each adapted to hold columns of cards in overlapped relation. Disposed at the forward end of the board is an upstanding four compartment card receptacle. Numbers may be disposed on selected steps of selected areas to serve as card placement guides. An elastic webbing may be employed to secure the board to a user's lap.

4 Claims, 9 Drawing Figures

SOLITAIRE GAME LAP BOARD

This invention comprises five great improvements in a solitaire lap board having no slip full size cards, from the positions the player lays them. Producing this lap board after 18 years spent making and discarding some that did not aid in the best enjoyable game. The game of solitaire started some 2,488 years ago, and now its reported to have 46 million players in the U.S. alone, plus Europe and Asia. It is reported and well established that some players play fifty games a day, while some play only one game a week. This lack of playing is due to only one thing mostly, and that is that the glossy slick cards slip and slide all over the table top, bed or other surfaces. Having a light weight metallic or plastic board, that permits the player to sit in their favorite chair, laying the board on their lap, and passing the elastic webbing under their legs and attaching to the board. They then put the little card box on the boards top portion. The official rules for playing Mon-Te-Car-Lo, Las Vegas, Klondike and some other names are the same game if played by one person. The little card box holds the cards from ace to King of the same suit, as they become available. The official rules of the game are under acrylic plastic (the no scratch plastic) which likewise serves as a space to shuffle the cards. My greatest improvement was the vertical ribs to prevent the cards from getting mixed up, plus the steps with the numbers to aid the player in covering the number with the lower portion of his card. The full size cards are in full view, so easily played from vertical row to the other, as the game proceeds. Thousands of former solitaire players will return to the game when they see the light weight board that rests securely on their lap, keeps the cards in place and even helps their nervous condition. Having all the full size cards in view at all times, will be worth its weight in gold to pass the many lonely hours for all senior citizens. The finger recesses at the top of each vertical section helps the player pick up the cards very quickly when game is lost or won. Having developed my lap board I now describe it.

Figure 1:
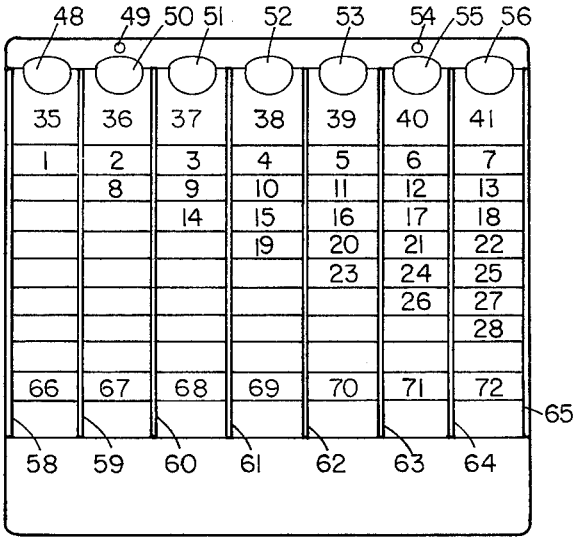
FIG. 1 is a top plan view of the lap board.
Figure 5:
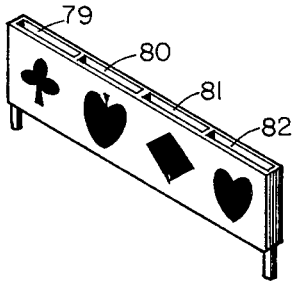
FIG. 5 is a perspective view of the four compartment card box.
Figure 4:
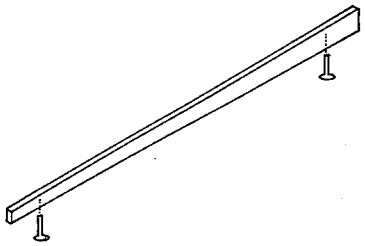
FIG. 4 is a perspective view of a removable divider.
Figure 3:
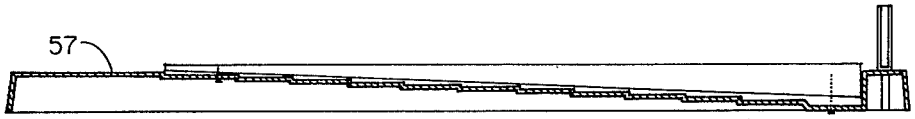
FIG. 3 is a sectional side view of the lap board.

FIG. 1 is a view looking down upon the lap board as if on a table, prior to placing the card box, FIG. 5, upon the upper part of board. The board may be of most any sheet metal, like aluminum. If of metal, the vertical divisional strips would be made separately and attached, shown in FIG. 4. If the lap board is of plastic, it can be molded in one piece with the exception of the four compartment card box that would be molded in two pieces. The card box can have its legs inserted in the holes 49 and 54.

Figure 2:
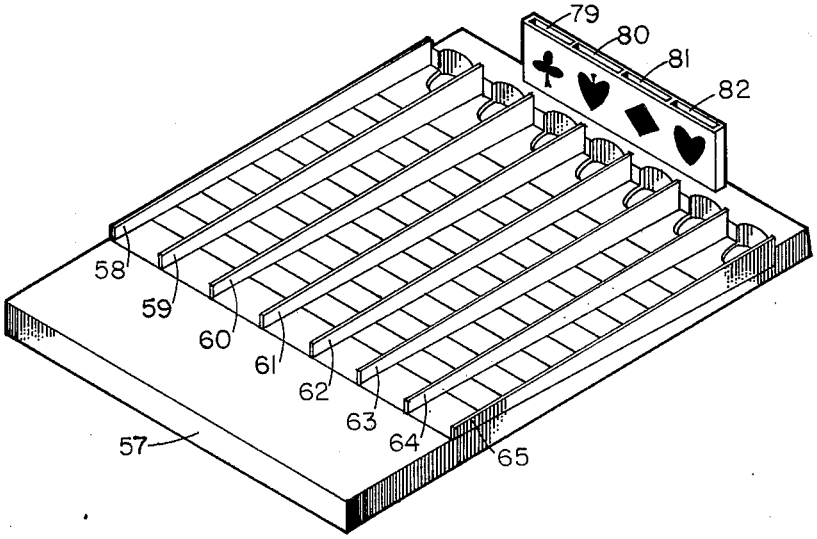
FIG. 2 is a perspective view of the lap board.
Figure 6:
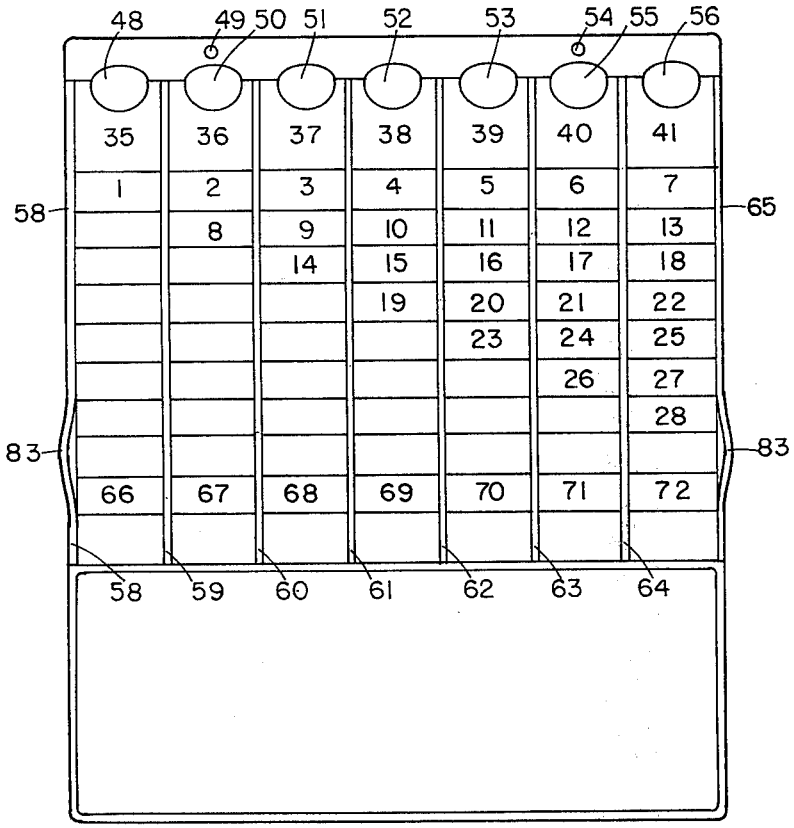
FIG. 6 is a top plan view of the board provided with sequential numbering on the steps and with bowed out portions medially of the side walls.
Figure 9:
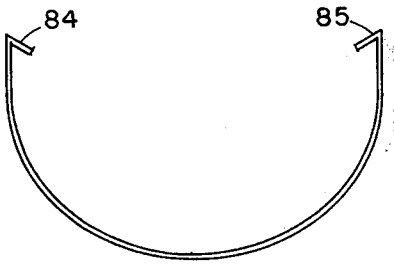
FIG. 9 shows the elastic webbing which secures the board to a user's lap.
Figure 8:
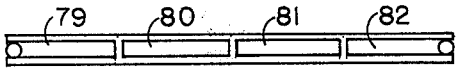
FIG. 8 is a top plan view of the card box.
Figure 7:
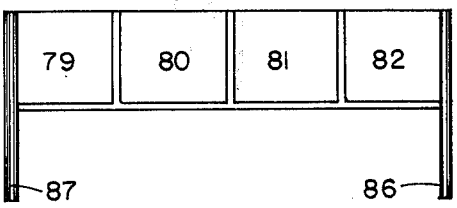
FIG. 7 shows the back portion of the box with the front removed.

Adjoining the upper portion of board are seven finger recesses, permitting the player to remove the upper cards easily. These finger recesses are numbered 48, 50, 51, 52, 53, 55, and 56. They are approximately ¼ inch deep and 1½ inch diameter. The seven card spaces are numbered 66, 67, 68, 69, 70, 71 and 72. The vertical separators numbered 58, 59, 60, 61, 62, 63, 64 and 65. The space where these numbers are is the space covered by acrylic plastic, under which appears the official solitaire playing rules. It is likewise used by the player to shuffle the full size cards prior to starting the game, and when the one time through the deck, solitaire is played. FIG. 5 is the four compartment card box for cards aces to kings are to be placed, with hearts, diamonds, clubs and spades will be placed behind that suit. FIG. 6 is the same as FIG. 1 with the exception of the right and left outside rim extended approximately ¼ inch at numeral 83. These two places are for the hooks 84 and 85 in FIG. 9 to slip on the board after passing under the players legs. This elastic webbing in FIG. 9 is of a length to stretch just enough to steady the board upon the lap of the player. When shuffling the deck of cards or other body movements will hold the lap board in place. FIG. 7 is of the back portion of the ace or card box as it would be molded, with the front off, which is shown on the back in FIG. 5 and FIG. 2. FIG. 6 also shows the lower portion of lap board to have a recess of ¼ inch deep and approximately 8 inches wide and 21 inches long that the official rules of all the games known to millions of players, where one person plays the game. These official rules will be covered with acrylic plastic, to shuffle cards on. FIG. 8 shows the card box from the top, with four spaces available. Outer rim in FIG. 6 extends so hooks will not affect the vertical row of cards. Official rules are now give for those not familiar with the game. After you have selected chair, without side arms, or use a pillow in the chair, attach the elastic webbing to the lower part of the board, after passing the elastic under your legs. Then take the four compartment card box, and place the legs into the holes you find in the top most edge. Take a full size deck of cards, discarding the joker, leaving you 52 cards. The lower portion of the board (next to your body) serves a double purpose, you shuffle the card thoroughly here before each game, and the official rules for one person to play the game. You no doubt have noticed that the board has every improvement worth while. After shuffling the cards into your right hand face down (every card face down) so you won't cheat which makes it hard to beat. With the cards in your right hand, push off the top card with your thumb. Turn the card over (face up) and place it with the bottom portion covering the numeral one against card stop step. Then push off one card at a time with the thumb and cover numerals 2 to 7. Then turn face up the next card and cover numeral 8 and 9 to 13 face down. Cover 14 face up, and 15 to 18 face down. Cover 19 face up and 20 to 22 face down. Cover 23 face up and 24 and 25 face down. 26 face up and 27 face down, with 28 face up. The player probably noticed that he had 28 numerals on the board. If any of these numerals are showing, you have made an error. You are supposed to have 24 cards in your right hand. But do not shuffle them or turn them over. There are two ways to finish the game from here on. The most popular one is to push off the cards at a time (keeping them as a unit) turn the three over together, and you can play the top card, if it will play. When you have completed the 28 cards on the board, you were to have every last card in a vertical face up. If you have any aces face up you can play them in the card box behind their insignia. Then if there is a card (face down) that was under the ace, you can turn it over, and play it if it will play. There is one rule to remember, never play a red card upon a red card. You must always play black on red and red on black, and always be a value less. For instance, a black jack can only play on a red queen, or a red queen on a black king. A black 9 on a red ten, a red 7 on a black 8. If any of the top cards become vacant, only a king can be put there, any color. If you have a king in the top of any vertical row (face up) you can put a queen of another color. In your ace box on the top of your board may have an ace in each compartment. You can add any deuce of the same suit to this ace. The whole idea of playing solitaire is to get as many cards out, into the ace box, as you possibly can. For the joy of it, charge your self $52.00 for the deck of cards, and credit yourself with $5.00 for each card you place in the ace box. When you have started to play, and the 28th. card had been placed, put any face up ace cards in the ace box, then play all face up black cards if they are a numeral that is lower, likewise red cards on black if they are lower numeral. This is prior to the pushing off of the first three cards. Turn the three over as a unit, playing the top card if you can. You may put it in the ace box or play black on red or red on black. If there is no play, push off with the right thumb three more cards. Continue this three at a time, playing the top card of the three after you turned them over. If you have went the 24 cards you had in your right hand with no plays, Solitaire has beat you at the game. You can run a debit and credit of the games you play that day, week or month. You make $260.00 when you beat the game, and are $208.00 to the good every game you beat.

The second best solitaire game played is thusly. Turn the 24 cards down (face down) on the right side of your playing instructions. Turn up one card from this pile, turn it over and play it if you can. If you cannot play it, start a pile on the left side of the instructions (face up) and pick up the second card from the right side pile (one single card at a time) until you have went through the 24 cards. Many times you will have six to ten cards in the left hand pile. Turn the next card, play it, then play all the left hand pile of cards, one at a time. That last card you turned, started the others to all play. When you have went through the 24 cards on the right side one time, and can play none of the left pile, you are beaten at the game. While when playing the game pushing off three cards at a time, you can continue going through the cards three at a time, until you can play no more. Every card you played from the three at a time automatically shuffled the remaining cards for you.

I claim:

1. A solitaire game board comprising a rigid main body, flat surface areas at the forward and rearward portions of the body, the rearward portion being of a size suitable to shuffle a deck of cards thereon, a receptacle having four open compartments each of a size to accomodate a plurality of conventionally sized playing cards, means for removably attaching said receptacle to said forward portion with the compartments opening upwardly, the body portion between the forward and rearward portions comprising a surface having at least seven equally spaced steps descending from the rearward portion to the forward portion, vertically and longitudinally extending dividers disposed on said stepped surface and dividing said surface into seven equal sized areas each extending between the rearward and forward portions, each area being of a size to accomodate at least seven conventionally sized playing cards in longitudinally extending overlapped relation with the edges of successive cards abutting successive steps, and a finger recess disposed at the forward end of each area.

2. A solitaire game board as defined in claim 1 wherein the rightmost and leftmost dividers are provided with intermediately disposed outwardly bowed portions, and further including an elastic webbing having hooks at its extremities adapted to engage said bowed portions, whereby the game board can be secured to the user's lap.

3. A solitaire game board as defined in claim 1 wherein the numerals 1 through 28 are disposed on selected steps to serve as a guide for the sequential placement of cards thereon.

4. A solitaire game board as defined in claim 1 wherein said dividers are removably attached to said main body.

* * * * *